US009770053B2

(12) United States Patent
Sebastian

(10) Patent No.: US 9,770,053 B2
(45) Date of Patent: Sep. 26, 2017

(54) DEGRADABLE FILTER ELEMENT

(71) Applicant: R. J. REYNOLDS TOBACCO COMPANY, Winston-Salem, NC (US)

(72) Inventor: Andries D. Sebastian, Clemmons, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 1087 days.

(21) Appl. No.: 13/787,123

(22) Filed: Mar. 6, 2013

(65) Prior Publication Data

US 2013/0180536 A1 Jul. 18, 2013

Related U.S. Application Data

(62) Division of application No. 12/539,226, filed on Aug. 11, 2009, now Pat. No. 8,434,498.

(51) Int. Cl.

| | |
|---|---|
| ***A24D 3/06*** | (2006.01) |
| ***A24D 3/08*** | (2006.01) |
| ***A24D 3/14*** | (2006.01) |

(52) U.S. Cl.

CPC ..... *A24D 3/068* (2013.01); *A24D 3/08* (2013.01); *A24D 3/14* (2013.01)

(58) Field of Classification Search

None

See application file for complete search history.

(56) References Cited

U.S. PATENT DOCUMENTS

| | | |
|---|---|---|
| 2,066,340 A | 1/1937 | Dreyfus |
| 2,794,239 A | 6/1957 | Crawford et al. |

(Continued)

FOREIGN PATENT DOCUMENTS

| | | |
|---|---|---|
| CA | 2 121 136 C | 3/2001 |
| WO | WO 03/009711 | 2/2003 |
| WO | WO 03/047836 | 6/2003 |

OTHER PUBLICATIONS

Fabunmi et al., "Developing Biodegradable Plastics From Starch," *American Society of Agricultural and Biological Engineers* (*ASABE*), 2007, Paper No. RRV-07130, (Written for Presentation at the 2007 ASABE/CSBE North Central Intersectional Conference Sponsored by the Red River Valley Section of ASABE, North Dakota State University, Fargo, North Dakota, USA.

(Continued)

*Primary Examiner* — Michael J Felton

(74) *Attorney, Agent, or Firm* — Womble Carlyle Sandridge & Rice, LLP

(57) ABSTRACT

A filter material adapted for use as a filter element of a smoking article is provided, the filter material including at least one segment of fibrous tow having a plurality of degradable particles dispersed therein, the degradable particles comprising a starch material. Exemplary starch materials include naturally-occurring starch, hydroxyalkylated starch, starch esters, ionically modified starch, oxidized starch, hydrolyzed starch, plasticized starch, gelatinized starch, grafted starch, crosslinked starch, transglycosylated starch, starch ethers, and mixtures thereof, as well as blends of starch with other polymers. Filter elements and smoking articles, such as cigarettes, that contain the filter material are also provided. A method of preparing polymer fibers for use in filter elements is also provided, the method including adding the starch material to a fiber precursor solution prior to fiber extrusion or dry-blending the starch material with the polymer material to be formed into fibers.

12 Claims, 2 Drawing Sheets

(56) References Cited

U.S. PATENT DOCUMENTS

| | | | | |
|---|---|---|---|---|
| 2,953,838 | A | 9/1960 | Crawford et al. | |
| 3,422,176 | A * | 1/1969 | Jamison | A24D 3/10 131/343 |
| 3,424,172 | A | 1/1969 | Neurath et al. | |
| 4,201,234 | A * | 5/1980 | Neukomm | A24D 3/04 131/342 |
| 4,811,745 | A | 3/1989 | Cohen et al. | |
| 4,920,990 | A | 5/1990 | Lawrence et al. | |
| 4,925,602 | A | 5/1990 | Hill et al. | |
| 5,012,829 | A | 5/1991 | Thesing et al. | |
| 5,025,814 | A | 6/1991 | Raker | |
| 5,074,320 | A | 12/1991 | Jones, Jr. et al. | |
| 5,105,838 | A | 4/1992 | White et al. | |
| 5,225,277 | A | 7/1993 | Takegawa et al. | |
| 5,271,419 | A | 12/1993 | Arzonico et al. | |
| 5,360,023 | A | 11/1994 | Blakley et al. | |
| 5,387,285 | A | 2/1995 | Rivers | |
| 5,396,909 | A | 3/1995 | Gentry et al. | |
| 5,446,140 | A | 8/1995 | Maheras et al. | |
| 5,453,144 | A | 9/1995 | Kauffman et al. | |
| 5,709,227 | A | 1/1998 | Arzonico et al. | |
| 5,718,250 | A | 2/1998 | Banerjee et al. | |
| 5,780,568 | A | 7/1998 | Vuorenpaa et al. | |
| 5,911,224 | A | 6/1999 | Berger | |
| 5,913,311 | A | 6/1999 | Ito et al. | |
| 5,947,126 | A | 9/1999 | Wilson et al. | |
| 5,970,988 | A | 10/1999 | Buchanan et al. | |
| 6,011,092 | A | 1/2000 | Seppälä et al. | |
| 6,045,908 | A | 4/2000 | Nakajima et al. | |
| 6,062,228 | A | 5/2000 | Loercks et al. | |
| 6,136,246 | A | 10/2000 | Rauwendaal et al. | |
| 6,344,239 | B1 | 2/2002 | Asai et al. | |
| 6,369,215 | B1 | 4/2002 | Peltonen et al. | |
| 6,495,679 | B1 | 12/2002 | Tanaka | |
| 6,514,526 | B1 | 2/2003 | Forssell et al. | |
| 6,571,802 | B1 | 6/2003 | Yamashita | |
| 6,595,217 | B1 | 7/2003 | Case et al. | |
| 6,605,715 | B1 | 8/2003 | Lammers et al. | |
| 6,617,449 | B2 | 9/2003 | Tanaka | |
| 6,780,903 | B2 | 8/2004 | Peltonen et al. | |
| 7,435,208 | B2 | 10/2008 | Garthaffner | |
| 2002/0096300 | A1 | 7/2002 | Yamashita | |
| 2002/0166563 | A1 | 11/2002 | Jupe et al. | |
| 2004/0003822 | A1 | 1/2004 | Atindranath | |
| 2004/0261807 | A1 | 12/2004 | Dube et al. | |
| 2005/0066981 | A1 | 3/2005 | Crooks et al. | |
| 2005/0107603 | A1 | 5/2005 | Peltonen et al. | |
| 2006/0090769 | A1 | 5/2006 | Woodson et al. | |
| 2006/0124142 | A1 | 6/2006 | Zhang | |
| 2006/0128889 | A1 | 6/2006 | Mikkonen et al. | |
| 2006/0144412 | A1 | 7/2006 | Mishra et al. | |
| 2006/0157070 | A1 | 7/2006 | Belcastro et al. | |
| 2007/0056600 | A1 | 3/2007 | Coleman, III et al. | |
| 2008/0029118 | A1 | 2/2008 | Nelson et al. | |
| 2008/0302373 | A1 | 12/2008 | Stokes et al. | |

OTHER PUBLICATIONS

Myllärinen, Academic Dissertation: "Starches—From Granules to Novel Applications," *VTT Publications* 473, 2002, University of Helsinki, Department of Food Technology, VTT Technical Research Centre of Finland.

* cited by examiner

DEGRADABLE FILTER ELEMENT

CROSS-REFERENCE TO RELATED APPLICATIONS

This application is a divisional of U.S. patent application Ser. No. 12/539,226, filed Aug. 11, 2009, which is hereby incorporated herein by reference in its entirety.

FIELD OF THE INVENTION

The present invention relates to tobacco products, such as smoking articles (e.g., cigarettes), and in particular, to filters for cigarettes. The invention is directed to additives for filter elements adapted for increasing the rate of degradation.

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The discarded portion of the cigarette rod is primarily composed of the filter element, which typically consists of tightly-compacted and highly crimped cellulose acetate fibers bonded at their contact points and wrapped by the a plug wrap and tipping paper. The presence of the wrapping materials, the fiber-to-fiber bonding, and the compacted nature of conventional filter elements has a detrimental effect on the rate of degradation of cigarette filters in the environment. Unless the filter element is unwrapped and the fibers spread apart to increase exposure, biodegradation of the filter can take several years.

A number of approaches have been used in the art to promote an increased rate of degradation of filter elements. One approach involves incorporation of additives (e.g., water soluble cellulose materials, water soluble fiber bonding agents, photoactive pigments, or phosphoric acid) into the cellulose acetate material in order to accelerate polymer decomposition. See U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita. In some cases, conventional cellulose acetate has been replaced with other materials, such as moisture disintegrative sheet materials, extruded starch materials, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al. Incorporation of slits into a filter element has been proposed for enhancing biodegradability, such as described in U.S. Pat. No. 5,947,126 to Wilson et al. and U.S. Pat. No. 7,435,208 to Garthaffner. U.S. Pat. No. 5,453,144 to Kauffman et al. describes use of a water sensitive hot melt adhesive to adhere the plug wrap in order to enhance biodegradability of the filter element upon exposure to water. U.S. Pat. No. 6,344,349 to Asai et al. proposes to replace conventional cellulose acetate filter elements with a filter element comprising a core of a fibrous or particulate cellulose material coated with a cellulose ester to enhance biodegradability.

There remains a need in the art for a smoking article filter exhibiting enhanced environmental degradation properties, particularly where the filter can be manufactured with only minor modification of conventional filter rod production equipment.

SUMMARY OF THE INVENTION

The present invention relates to a smoking article, and in particular, a rod-shaped smoking article (e.g., a cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element comprising a fibrous tow filter material. The fibrous tow filter material incorporates an effective amount of a degradable starch material (or other degradable polymer material) adapted for increasing the rate of degradation of the filter material upon disposal. Dispersal of the degradable material throughout the fibrous tow can enhance degradation by creating voids within the fibrous tow as the degradable material decomposes, thus increasing available surface area within the fibrous tow for contact with the environment. The degradable particles can be dispersed and imbedded within the filaments that form the fibrous tow or dispersed and entrapped as an additive between the individual filaments of the tow.

In one aspect, the invention provides a filter material adapted for use as a filter element of a smoking article, comprising at least one segment of fibrous tow (e.g., cellulose acetate tow or polyolefin tow) having a plurality of degradable particles dispersed therein, the degradable particles comprising a starch material. Exemplary starch materials include naturally-occurring starch, hydroxyalkylated starch, plasticized starch, starch esters, ionically modified starch, oxidized starch, hydrolyzed starch, gelatinized starch, grafted starch, crosslinked starch, transglycosylated starch, starch ethers, and mixtures thereof. The starch material can be derived from a variety of plant sources including corn, potato, tapioca, rice, oat, peas, sago, barley, wheat, cassava, and yam. Blends of starch materials with other polymeric materials can be used, such as blends with a biodegradable thermoplastic polymer. Exemplary blending partners include polyglycolic acid, polylactic acid, polyhydroxy butyrate, polyhydroxy valerate, polycaprolactone, poly(ester urethanes), and aliphatic-aromatic copolyesters.

Certain specific examples of starch materials include starch esters having a degree of substitution of between about 0.5 and about 3, hydroxypropyl starch, and hydroxypropyl starch ester. The solubility characteristics of the starch material used in the invention can vary. In certain embodiments, the starch material is water soluble and/or insoluble in acetone or other common solvents used in cellulose acetate fiber manufacture.

The invention also provides filter elements for smoking articles such as cigarettes, wherein the filter element comprises one or more segments of fibrous tow filter material as described herein. For example, the filter element can comprise a first segment of fibrous tow filter material and a second segment of fibrous tow filter material, wherein the first segment of fibrous tow filter material comprises a starch material as described herein and the second segment is devoid of starch material.

In another aspect, the invention provides a cigarette comprising a tobacco rod having a smokable filler material contained within a circumscribing wrapping material and a filter element connected to the tobacco rod at one end of the tobacco rod, the filter element comprising at least one segment of fibrous tow having a plurality of degradable particles dispersed therein, the degradable particles comprising a starch material.

In yet another aspect, the invention provides a method of preparing cellulose acetate or polyolefin fibers suitable for use in a fibrous tow filter material. The method comprises the steps of (a) providing a cellulose acetate or polyolefin polymer material; (b) adding a starch material to the polymer material to form a modified polymer material; (c) extruding the modified polymer material through a spinerette to produce cellulose acetate or polyolefin fibers; (d) solidifying the fibers following extrusion; and (e) collecting the solidified fibers, the fibers comprising the starch material imbedded therein. The solidified fibers comprising the starch component can be used to form a fibrous tow filter rod adapted for use in smoking article manufacture, and the filter rod can be attached to a tobacco rod to form a smoking article. Methods for adding the starch material to the cellulose acetate or polyolefin polymer material include dry-blending the polymer material with the starch material (e.g., in particulate form) or adding a starch material (e.g., in particulate form) to a fiber precursor solution comprising cellulose acetate or a polyolefin dissolved in a solvent.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Figure 1:
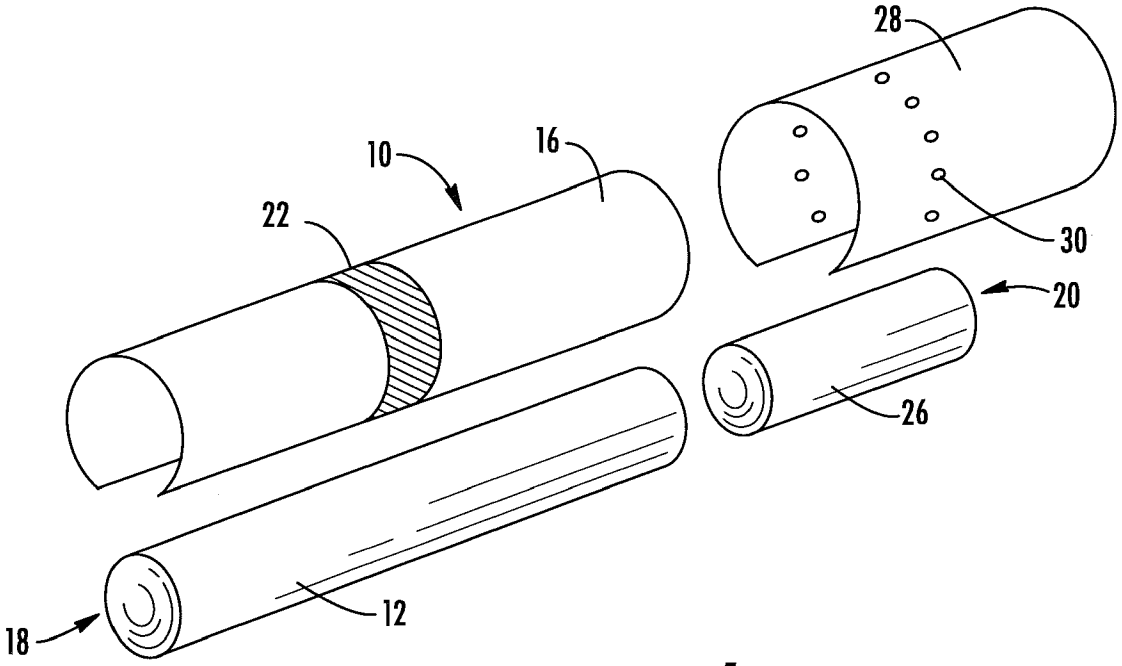
FIG. 1 is an exploded perspective view of a smoking article having the form of a cigarette, showing the smokable material, the wrapping material components, and the filter element of the cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

Figure 2:
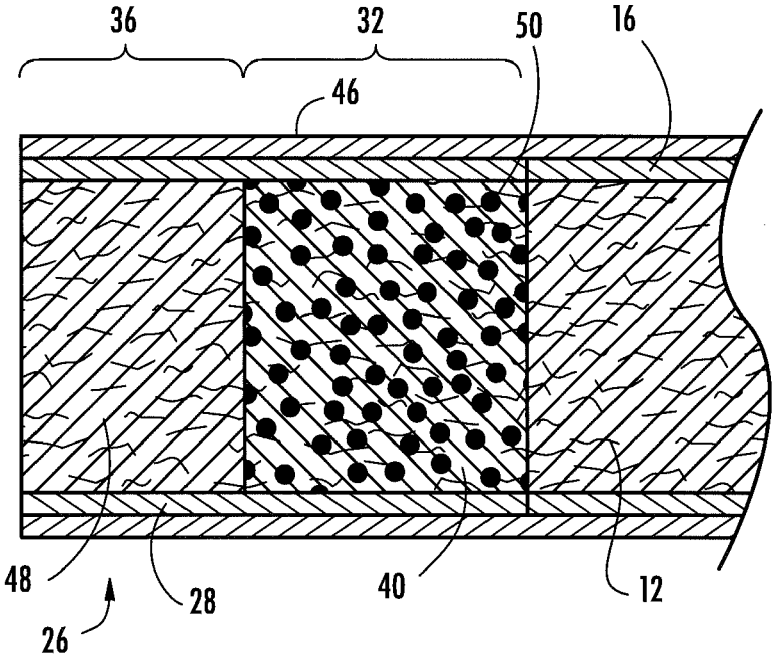
FIG. 2 is a cross-sectional view of one embodiment of a filter element according to the invention.

An exemplary filter element 26 configuration is shown in FIG. 2; the filter including a first filter segment 32 positioned adjacent one end of the tobacco rod 12. The first filter segment 32 includes filter material 40 (e.g., cellulose acetate tow impregnated with plasticizer, such as triacetin). Within the filter material 40 of the first segment is dispersed a plurality of degradable particles 50. If desired, the filter element also can be incorporate other components that have the ability to alter the properties of the mainstream smoke that passes throughout the filter element, such as adsorbent materials or flavorants. Exemplary adsorbent materials include activated carbon and ion exchange resins, and exemplary flavorants include flavorant-containing capsules and solid botanical additives such as peppermint or spearmint leaves or other plant-based flavorants in particulate form. See, for example, U.S. Pat. No. 6,041,790 to Smith et al. and US Pat. Application Publication Nos. 2004/0237984 to Figlar et al.; 2005/0268925 to Schluter et al.; 2006/0130861 to Luan et al.; and 2006/0174899 to Luan et al., which are incorporated herein by reference.

The filter element 26 possesses a second filter segment 36 longitudinally disposed relative to the first segment 32 and positioned at the extreme mouth end of the cigarette 10. The second filter segment 36 includes filter material 48 (e.g., cellulose acetate tow impregnated with plasticizer, such as triacetin). As shown, the second filter segment 36 does not contain the degradable particles 50; however, such particles can be present in all filter segments if desired. A filter segment devoid of the degradable particles encompasses segments having no more than about 0.5 weight percent of the degradable particles, based on the total weight of the filter segment.

The filter element 26 is circumscribed along its outer circumference or longitudinal periphery by a layer of outer plug wrap 28. The outer plug wrap 28 overlies each of the first filter segment 32 and the second filter segment 36, so as to provide a combined, two-segment filter element.

The filter element 26 is attached to the tobacco rod 12 using tipping material 46 (e.g., essentially air impermeable tipping paper), that circumscribes both the entire length of the filter element 26 and an adjacent region of the tobacco rod 12. The inner surface of the tipping material 46 is fixedly secured to the outer surface of the plug wrap 28 and the outer surface of the wrapping material 16 of the tobacco rod, using a suitable adhesive; and hence, the filter element and the tobacco rod are connected to one another.

A ventilated or air diluted smoking article can be provided with an optional air dilution means, such as a series of perforations 30, each of which extend through the tipping material and plug wrap. The optional perforations 30, shown in FIG. 1, can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the cigarette 10, through the filter element 26, and into the mouth of the smoker. Following use of the cigarette 10, the filter element 26 and any residual portion of the tobacco rod 12 can be discarded. The presence of the degradable particles can increase the rate of degradation of the filter element 26. The particles will typically degrade at a faster rate than the surrounding fibrous tow material and, as a result, voids within the filter element 26 will be created. The voids provide additional surface area within the filter element 26 for contact with environmental elements such as moisture and air, which may enhance the rate of degradation of the fibrous tow.

Other filter element arrangements could be used without departing from the invention. For example, the filter element could include more than the two segments set forth in FIG. 2. The filter element could also include a cavity formed between two filter material segments. Still further, the filter segment comprising the dispersed degradable particles can be more centrally located within the filter element with one or more filter segments that do not contain the particles on each side. Alternatively, all filter segments could include the degradable particles.

The dimensions of a representative cigarette 10 can vary. Preferred cigarettes are rod-shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; US Patent Publication Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Most preferably, the entire smokable rod is composed of smokable material (e.g., tobacco cut filler) and a layer of circumscribing outer wrapping material.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

Filamentary tow, such as cellulose acetate, is processed using a conventional filter tow processing unit such as a commercially available E-60 supplied by Arjay Equipment Corp., Winston-Salem, N.C. Other types of commercially available tow processing equipment, as are known to those of ordinary skill in the art, may similarly be used.

As illustrated in FIG. 2, the filter element of the invention typically comprises multiple, longitudinally-extending segments. Each segment can have varying properties and may include various materials capable of filtration or adsorption of particulate matter and/or vapor phase compounds. Typically, the filter element of the invention includes 1 to 6 segments, frequently 2 to 4 segments. In one preferred embodiment, the filter element includes a mouth end segment and a tobacco end segment, with the tobacco end segment comprising the dispersed degradable particles.

The degradable particles can be made of any filler material that is degradable, meaning the material is capable of undergoing degradation or decomposition, for example through chemical reaction that breaks down the particles into decomposition products, particularly under environmental conditions associated with disposal of the filter material. One exemplary type of degradation is biodegradation. As used herein, the term "biodegradable particle" refers to a particulate material that degrades under aerobic and/or anaerobic conditions in the presence of bacteria, fungi, algae, and other microorganisms to carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain filter element embodiments of the invention include a weight loss of at least about 20% after burial in soil for 60 days or a weight loss of at least about 30% after 15 days of exposure to a typical municipal composter. However, rates of biodegradation can vary widely depending on the type of degradable particles used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing.

Exemplary biodegradable materials include, without limitation, starch, cellulosic or other organic plant-derived fibrous materials (e.g., cotton, wool, cedar, hemp, bamboo, kapok, or flax), polyvinyl alcohol, aliphatic polyesters, aliphatic polyurethanes, cis-polyisoprene, cis-polybutadiene, polyhydroxy alkanoates, polyanhydrides, and copolymers and blends thereof. The term "aliphatic polyester" refers to polymers having the structure $—[C(O)—R—O]_n$, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxy butyrate (PHB), polyhydroxy valerate (PHV), polycaprolactone (PCL), and copolymers thereof.

As used herein, "starch" refers to a is a polysaccharide-based carbohydrate polymer $(C_6H_{10}O_5)_n$ comprising glucose units joined together by glycosidic linkages, and can be characterized primarily as a mixture of linear (amylose) and branched (amylopectin) polymers. Amylose is essentially a linear polymer of $\alpha(1\rightarrow4)$ linked D-glucopyranosyl units. Amylopectin is a highly-branched polymer of D-glucopyranosyl units containing $\alpha(1\rightarrow4)$ linkages, with $\alpha(1\rightarrow6)$ linkages at the branch points. Naturally-occurring corn starch contains about 75% amylopectin (higher molecular weight branched starch polymer) and 25% amylose (lower molecular weight linear starch polymer), although hybrid corn starch products containing more than 50% amylose are sold by National Starch and Chemical Company Corporation and American Maize Products Company. The amount of amylose and amylopectin within the starch used in the present invention can vary, although the amylose content is typically about 5% to about 90% by weight with the remainder being amylopectin. Natural starch is a partially crystalline structure (e.g., about 15 to about 45% crystallinity) that is hydrophilic, with much of the swelling in water occurring in the amorphous sections of the molecule.

The starch may be used in its natural form (e.g., as extracted from one or more plants, or as purified by any method), in a destructured form, in any number of chemically modified derivative forms (e.g., hydroxyalkylated starch, starch esters, ionically modified starches including cationic starch derivatives and anionic starch derivatives, oxidized starches, plasticized starches, hydrolyzed starches, gelatinized starch, grafted starches, crosslinked starches, transglycosylated starches, starch ethers, or the like, or mixtures thereof), or in the form of a blend with other polymer components. Certain modifications of starch increase hydrophobicity of the material, which can be done without departing from the invention. Although starch isolated and/or purified from any plant sources may be useful in the present invention, exemplary starch sources include corn, potato, tapioca, rice, oat, peas, sago, barley, wheat, cassava, and yam.

One example of a starch material that can be used is sold under the tradename COHPOL™ by VTT Chemical Technology of Finland. Waxy maize-based modified starches are available as Novation 9230, National 465, and WNA from National Starch and Chemical Company. Exemplary cold water soluble dextrin starch-based materials are available as N-Tack, Versa Sheen, and Crystal Tex 627 from National Starch and Chemical Company. An oxidized tapioca starch is available as Flo-Max 8 and an oxidized waxy maize corn starch is available as Flokote 64 Starch, both from National Starch & Chemical Company. One example of a grafted starch comprises a starch derivative grafted with an aliphatic polyester formed from copolymerization of the starch with a cyclic ester. Additional exemplary starch materials are described in U.S. Pat. No. 5,780,568 to Vuorenpaa et al.; U.S. Pat. No. 6,011,092 to Seppala et al.; U.S. Pat. No. 6,369,215 to Pletonen et al.; U.S. Pat. No. 6,514,526 to Forssell et al.; U.S. Pat. No. 6,605,715 to Lammers et al.; and U.S. Pat. No. 6,780,903 to Pletonen et al., and US Patent Publication Nos. 2005/0107603 to Pletonen et al. and 2006/0128889 to Mikkonen et al., which are incorporated herein by reference in their entirety.

Blends of starch with synthetic polymer materials or other additives can be used. Blends of starch with other polymers are available from Novamont SpA (e.g., Mater-Bi® polymer blends containing starch and polyvinyl alcohol), Warner-Lambert (e.g., Novon® blends containing starch and copolyester, polycaprolactone or cellulose acetate), and SK Corporation (e.g., Greenpol™ blends comprising starch and polycaprolactone). Other examples of polymers suitable for blending with a starch material include biodegradable thermoplastic polyesters such as Ecoflex® aliphatic-aromatic copolyester materials available from BASF Corporation or poly(ester urethane) polymers described in U.S. Pat. No. 6,087,465 to Seppala et al., which is incorporated by reference herein in its entirety. Plasticizers and other filler ingredients can also be used in such blends.

Starch materials used in the invention can be admixed with plasticizers (i.e., plasticized starch) such as triacetin, diacetin, monoacetin, triethyl citrate, tributyl citrate, dimethyl succinate, fatty acid esters of glycerol, and the like. The amount of plasticizer is typically about 0.01 to about 75% by weight, more typically about 1 to about 50% by weight. Other additives, such as protective colloids and surfactants can be added to the starch material. Exemplary colloids include polyvinyl alcohol, alkyl ether dimer, beeswax, carnauba wax, and the like. The amount of protective colloid used is usually about 0.5 to about 60% by weight, more typically about 1 to about 50% by weight. Exemplary surfactants include polyoxyethylene derivatives (e.g., polysorbates), saponin, alkyl sulfonates, alkyl benzene sulfonates, and the like. The surfactants are typically present in an amount of about 0.1 to about 20% by weight, more typically about 0.5 to about 15% by weight.

One example of a starch material suitable for use in the invention is a starch ester formed by reaction between natural starch and one or more aliphatic C2-24 carboxylic acids, such as acetic acid, propionic acid, butyric acid, stearic acid, oleic acid, linoleic acid, or mixtures thereof. Reactive acid derivatives can also be used to form the starch ester, such as acid chlorides or acid anhydrides. Starch acetate can be formed by reacting starch with acetanhydride in the presence of a catalyst such as sodium hydroxide. The degree of substitution (DS) of the starch ester is typically between about 0.5 and about 3, more typically between about 1.2 and about 2.8.

In another embodiment, the starch material is a hydroxyalkylated starch (or ester thereof), such as hydroxypropyl starch (or hydroxypropyl starch acetate) having a molar degree of hydroxypropyl substitution of no more than about 2, more typically no more than about 1.5, and often no more than about 1.0.

The particle size of the degradable particles (e.g., the starch particles) can vary, but is typically small enough to ensure uniform dispersion throughout the fibrous tow filter material without unduly affecting the desirable filtration and mechanical properties of the fibrous tow. As used herein, reference to "particles" or "particulate" materials simply refers to discrete units of relatively small size but does not restrict the cross-sectional shape or overall geometry of the material, which can be characterized as spherical, oblong, ovoid, flake-like, irregular or the like without departing from the invention. The degradable particles usually have a particle size range of about 100 nm to about 20 microns, more typically about 400 nm to about 800 nm, and most often about 400 nm to about 600 nm. In certain embodiments, the particle size of the degradable particles can be characterized as less than about 20 microns, less than about 800 nm, or less than about 600 nm Certain embodiments of the degradable particles can be characterized as having a particle size of more than about 100 nm or more than about 400 nm.

The amount of degradable particles used in a filter element can vary, but typical weight percentages are in the range of about 5 to about 30% by weight, based on the overall dry weight of the filter element, more typically about 10 to about 20% by weight. In certain embodiments, the amount of degradable particles in the filter element can be characterized as more than about 5% by weight, more than about 10% by weight, or more than about 15% by weight, but less than about 60% by weight, less than about 50% by weight, or less than about 40% by weight.

In certain embodiments, the degradable particles (e.g., starch particles) are characterized as having certain solubility properties. For example, in certain applications, it may be desirable for the particles to have a high degree of solubility in water. In other embodiments, hydrophobicity (i.e., relatively low water solubility) will be desired. Many polymer materials, including starch materials, can be chemically modified in order to increase or reduce water solubility. In some embodiments, the particles can be viewed as highly soluble in water. In other embodiments, the particles have a low level of solubility in water and/or in certain other solvents, such as solvents used in the cellulose acetate fiber manufacturing process (e.g., the particles can be insoluble in acetone). As used herein, the term "soluble" refers to a material with a solubility in the given solvent of at least about 50 g/L, typically at least about 75 g/L, and often at least about 100 g/L at 25° C. A material characterized as "insoluble" refers to a material having a solubility in the given solvent of no more than about 5 g/L, typically less than about 2 g/L, and often less than about 0.5 g/L at 25° C.

The process for making filter elements according to the invention can vary, but a process for making cellulose acetate filter elements typically begins with forming cellulose fibers. The first step in conventional cellulose acetate fiber formation is esterifying a cellulose material. Cellulose is a polymer formed of repeating units of anhydroglucose. Each monomer unit has three hydroxyl groups available for ester substitution (e.g., acetate substitution). Cellulose esters may be formed by reacting cellulose with an acid anhydride. To make cellulose acetate, the acid anhydride is acetic anhydride. Cellulose pulp from wood or cotton fibers is typically mixed with acetic anhydride and acetic acid in the presence of an acid catalyst such as sulfuric acid. The esterification process of cellulose will often result in essentially complete conversion of the available hydroxyl groups to ester groups (e.g., an average of about 2.9 ester groups per anhydroglucose unit). Following esterification, the polymer is typically hydrolyzed to drop the degree of substitution (DS) to about 2 to about 2.5 ester groups per anhydroglucose unit. The resulting product is typically produced in flake form that can be used in subsequent processing.

To form a fibrous material, the cellulose acetate flake is typically dissolved in a solvent (e.g., acetone, methanol, methylene chloride, or mixtures thereof) to form a viscous solution. The concentration of cellulose acetate in the solution is typically about 15 to about 35 percent by weight. Additives such as whitening agents (e.g., titanium dioxide) can be added to the solution if desired. The resulting liquid is sometimes referred to as a liquid "dope."

The cellulose acetate dope is spun into filaments using a nonwoven fabric melt-spinning technique, which entails extruding the liquid dope through a spinerette. The filaments pass through a curing/drying chamber, which solidifies the filaments prior to collection. The collected fibers are combined into a tow band, crimped, and dried. Conventional crimp ratios are in the range of 1.2 to 1.8. The fibers are typically packaged in bales that are suitable for later use in filter element formation processes.

The process of forming the actual filter element typically involves mechanically withdrawing the cellulose acetate tow from the bale and separating the fibers into a ribbon-like band. The tow band is subjected to a "blooming" process wherein the tow band is separated into individual fibers. Blooming can be accomplished, for example, by applying different tensions to adjacent sections of the tow band or applying pneumatic pressure. The bloomed tow band then passes through a relaxation zone that allows the fibers to contract, followed by passage into a bonding station. The bonding station typically applies a plasticizer such as triacetin to the bloomed fibers, which softens the fibers and allows adjacent fibers to fuse together. The bonding process forms a homogenous mass of fibers with increased rigidity. The bonded tow is then wrapped in plug wrap and cut into filter rods. Cellulose acetate tow processes are set forth, for example, in U.S. Pat. No. 2,953,838 to Crawford et al. and U.S. Pat. No. 2,794,239 to Crawford et al., which are incorporated by reference herein.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Cigarette filter rods can be used to provide multi-segment filter rods. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; US Pat. Appl. Pub. Nos. 2002/0166563 to Jupe et al., 2004/0261807 to Dube et al.; 2005/0066981 to Crooks et al.; 2006/0090769 to Woodson; 2006/0124142 to Zhang et al.; 2006/0144412 to Mishra et al., 2006/0157070 to Belcastro et al.; and 2007/0056600 to Coleman, III et al.; PCT Publication No. WO 03/009711 to Kim; PCT Publication No. WO 03/047836 to Xue et al.; all of which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and US Patent Application Publication Nos. 2005/0103355 to Holmes, 2005/1094014 to Read, Jr., and 2006/0169295 to Draghetti, each of which is incorporated herein by reference.

Manners and methods for incorporating the degradable particles into desired regions of the filter element can vary. The particles can be incorporated into a polymeric material prior to fiber formation, incorporated into the fibrous filter materials during the fiber formation process, or incorporated into the fibrous tow during the rod-forming process.

For example, the particles could be introduced into the cellulose acetate or polyolefin "dope" prior to spinning the cellulose acetate or polyolefin fibers. In other words, the starch particles are admixed into the fiber precursor solution. In such an embodiment, the particles are preferably insoluble in the dope solvent (e.g., acetone) and instead form a slurry or dispersion in the liquid composition. Alternatively, the particles can be soluble in the dope solvent. Still further, the degradable particles could be dry-blended with the polymer (e.g., polypropylene or cellulose acetate) prior to fiber formation, such as by using a twin-screw extruder conventionally used to mix additives with polymeric materials. U.S. Pat. No. 6,136,246 to Rauwendaal et al., which is incorporated by reference herein, discloses an exemplary screw extruder that could be used to mix degradable particles with a polymer material prior to fiber formation. One advantage of incorporating the particles into the fibers prior to, or during, fiber formation is that each individual fiber that forms the fibrous tow filter material will have a plurality of degradable particles dispersed and imbedded therein, which may enhance degradation of the filter element produced using the fibers. The amount of degradable particles added to the fiber precursor solution or admixed with a polymeric material using a dry-blending technique is typically in the range of about 5 to about 40% by weight, more often about 10 to about 30% by weight, based on the total weight of the precursor solution or total weight of the blended components.

In another method, particulate materials can be incorporated into "dalmation" types of filter regions using the general types of techniques used to add particulate material in traditional dalmation filter manufacture. Techniques for production of dalmation filters are known, and representative dalmation filters have been provided commercially by Filtrona Greensboro Inc. Alternatively, any other known types of techniques and equipment for producing filter segments incorporating granular materials can be suitably altered so as to introduce degradable particles into regions of filter segments. The degradable particles can be applied to the fibrous tow as a slurry in a suitable solvent (e.g., water), or as free-flowing particulates. The particles can also be applied within a binder or adhesive matrix, or attached to a carrier material, such as a carrier fiber or capsule, and inserted into the fibrous tow with the carrier material. In certain alternative embodiments, the particles, particularly when applied in slurry form, can be introduced to the inner surface of the plug wrap or within the side seam adhesive formulation. Exemplary processes for introducing additives into fibrous filter tow during filter rod formation are set forth in US Patent Application Publication Nos. 2008/0029118 to Nelson et al. and 2008/0302373 to Stokes et al., as well as in U.S. application Ser. Nos. 12/124,891 filed May 21, 2008; U.S. Ser. No. 12/259,838 filed Oct. 28, 2008; and U.S. Ser. No. 12/407,260 filed Mar. 19, 2009, all of which are incorporated by reference herein in their entirety.

Filter elements of the present invention can be incorporated within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and US Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and US Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filter material adapted for use as a filter element of a smoking article, comprising at least one segment of fibrous tow having a plurality of degradable particles dispersed therein, the degradable particles comprising a starch material selected from the group consisting of (i) a starch ester formed by reaction between natural starch and one or more aliphatic C2-24 carboxylic acids or reactive derivatives thereof, and having a degree of substitution of 0.5 to 3; (ii) a hydroxyalkylated starch or ester thereof; (iii) an oxidized starch; (iv) a crosslinked starch; (v) a grafted starch; (vi) a transglycosylated starch; (vii) a plasticized starch; (viii) a starch ether; and a mixture thereof, wherein the fibrous tow comprises a plurality of individual filaments, and wherein the degradable particles are imbedded in the individual filaments.

2. The filter material of claim 1, wherein the starch material is derived from a plant source selected from the group consisting of corn, potato, tapioca, rice, oat, peas, sago, barley, wheat, cassava, and yam.

3. The filter material of claim 1, wherein the starch material is a polymer blend comprising a mixture of a starch and a second polymeric material.

4. The filter material of claim 3, wherein the second polymeric material is a biodegradable thermoplastic polymer.

5. The filter material of claim 4, wherein the biodegradable thermoplastic polymer is a polyester selected from the groups consisting of polyglycolic acid, polylactic acid, polyhydroxy butyrate, polyhydroxy valerate, polycaprolactone, poly(ester urethanes), and aliphatic-aromatic copolyesters.

6. The filter material of claim 1, wherein the starch material is a starch ester having a degree of substitution of between about 0.5 and about 3.

7. The filter material of claim 1, wherein the starch material is a hydroxypropyl starch or hydroxypropyl starch ester.

8. The filter material of claim 1, wherein the starch material is insoluble in acetone.

9. The filter material of claim 1, wherein the fibrous tow is cellulose acetate tow or polyolefin tow.

10. A filter element for a smoking article comprising one or more segments of fibrous tow comprising a filter material according to claim 1.

11. The filter element of claim 10, comprising a first segment of fibrous tow filter material and a second segment of fibrous tow filter material, wherein the first segment of fibrous tow filter material comprises said starch material and the second segment is devoid of said starch material.

12. A cigarette comprising a tobacco rod having a smokable filler material contained within a circumscribing wrapping material and a filter element connected to the tobacco rod at one end of the tobacco rod, said filter element comprising at least one segment of fibrous tow comprising a filter material according to claim 1.

* * * * *